US007896133B2

(12) United States Patent
Vance

(10) Patent No.: US 7,896,133 B2
(45) Date of Patent: Mar. 1, 2011

(54) SELF-ELEVATING PLATFORM SCAFFOLDING

(75) Inventor: Michael C. Vance, South Bend, IN (US)

(73) Assignee: Jerry Castle, Elk Grove Village, IL (US)

( * ) Notice: Subject to any disclaimer, the term of this patent is extended or adjusted under 35 U.S.C. 154(b) by 990 days.

(21) Appl. No.: 11/356,535

(22) Filed: Feb. 17, 2006

(65) Prior Publication Data

US 2007/0193831 A1 Aug. 23, 2007

(51) Int. Cl.
*E04G 3/28* (2006.01)

(52) U.S. Cl. ..... 182/141

(58) Field of Classification Search ..... 182/141; 187/270

See application file for complete search history.

(56) References Cited

U.S. PATENT DOCUMENTS

| | | | | | |
|---|---|---|---|---|---|
| 594,110 | A * | 11/1897 | Higgins | 74/465 |
| 682,861 | A * | 9/1901 | Rittman | 74/351 |
| 3,831,711 | A * | 8/1974 | Smith | 182/40 |
| 3,924,710 | A * | 12/1975 | Shohet | 187/270 |
| 3,937,301 | A * | 2/1976 | Bertail | 187/243 |
| 4,270,401 | A * | 6/1981 | Davidson | 74/462 |
| 4,294,332 | A | 10/1981 | Ready | |
| 4,664,226 | A * | 5/1987 | Centanne | 182/82 |
| 4,809,814 | A | 3/1989 | St-Germain | |
| 5,487,446 | A * | 1/1996 | Patnode et al. | 182/148 |
| 5,927,440 | A * | 7/1999 | Freeman | 187/270 |
| 6,095,285 | A | 8/2000 | St-Germain | |
| 6,137,962 | A * | 10/2000 | Namai | 396/401 |
| 6,311,800 | B1 * | 11/2001 | St-Germain et al. | 182/146 |
| 6,523,647 | B2 | 2/2003 | Duplessis | |
| 2001/0000003 | A1 * | 3/2001 | Cope | 182/141 |
| 2004/0020717 | A1 * | 2/2004 | Robillard | 182/141 |
| 2004/0154870 | A1 * | 8/2004 | Bass et al. | 187/270 |

FOREIGN PATENT DOCUMENTS

| | | | |
|---|---|---|---|
| JP | 55057753 | A * | 4/1980 |

* cited by examiner

*Primary Examiner*—Alvin C Chin-Shue
(74) *Attorney, Agent, or Firm*—Vedder Price P.C.

(57) ABSTRACT

The self-elevating platform scaffolding includes a horizontal work platform suspended from a vertical mast tower and a unique lift mechanism mounted to the work platform, which raises and lowers the platform along the length of the tower. The lift mechanism uses a pinion wheel that directly engages a mast tower to raise and lower the work platform along the mast towers. The pinion wheel has a plurality of radially spaced cogs that seat within crescent shaped openings in the mast tower. The lift mechanism is mounted to the work platform adjacent the mast tower such that rotation of the pinion wheel causes the wheel to "walk" up and down the mast tower to raise and lower the platform. The geometric configuration of the pinion wheel is designed so that at least two of the cogs are always in contact with the mast tower. As the pinion wheel turns, each successive cog seats within an adjacent crescent slot in the mast tower with its contact edge bearing against the bottom edge of tower opening.

1 Claim, 6 Drawing Sheets

SELF-ELEVATING PLATFORM SCAFFOLDING

FIELD OF THE INVENTION

The present invention relates to a scaffolding assembly, and in particular, a scaffolding assembly having a self-elevating work platform.

BACKGROUND OF THE INVENTION

Scaffolding and elevated work platforms are well known in the construction industry. Scaffolding assemblies having self-elevating work platforms, such as the ones manufactured by Hydro Mobile of L'Assomption, Quebec, are particular useful for moving workers and material to various positions on the building exterior. These scaffolding assemblies include a horizontal work platform suspended between a pair of vertical mast towers, which can be raised and lowered along the mast towers. For ease of explanation, such scaffolding assemblies will be referred to hereinafter simply as a "self-elevating platform scaffolding."

Typically, the work platform is raised and lowered by a "rack and pinion" lift mechanism. Rack and pinion type lift mechanisms use a drive motor mounted under the work platform to turn a pinion, which mates to a vertical rack mounted to the mast tower. In a construction site environment, dirt and debris quickly foul and damage the gear teeth of rack and pinion components. Consequently, rack and pinion type lift mechanisms require frequent maintenance to function properly. The safety and lifting capacity is also a limitation for rack and pinion type lift mechanisms.

Other self-elevating platform scaffoldings have a lift mechanism that uses a pair of hydraulic rams to "climb" the mast towers. Hydraulic rams are pivotally connected to the platform adjacent the mast towers and have hooks mounted to the ends of the upwardly extending piston rods, which engage cross members on the mast towers. Each ram operates in alternating succession to raise and lower the platform. The alternating operation of the paired rams creates an inherent intermittent stepping action in a "climbing" type lift mechanism, which presents safety concerns. A lift mechanism that provides a smooth continuous raising and lowering of the movable platforms is needed to provide a safer work environment.

SUMMARY OF THE INVENTION

The self-elevating platform scaffolding embodying this invention includes a horizontal work platform suspended from a vertical mast tower and a unique lift mechanism mounted to the work platform, which raises and lowers the platform along the length of the tower. The lift mechanism uses a pinion wheel that directly engage a mast tower to raise and lower the work platform along the mast towers. The pinion wheel has a plurality of radially spaced cogs that seat within crescent shaped openings in the mast tower. The lift mechanism is mounted to the work platform adjacent the mast tower such that rotation of the pinion wheel causes the wheel to "walk" up and down the mast tower to raise and lower the platform. The pinion wheel is driven by a hydraulic pump and operated by various hydraulic valves and controls. The hydraulic systems of the lift mechanism ensure safe and reliable operation of the scaffolding apparatus.

The lift mechanism allows the pinion wheel to operate in direct contact with the mast tower, thereby eliminating the need for rack sections mounted to the exterior of the towers.

The geometric configuration of the pinion wheel is designed so that one cog is always in positive contact with the mast tower. As the pinion wheel turns, each successive cog seats within an adjacent crescent slot in the mast tower with its contact edge bearing against the bottom edge of the tower opening. The lift mechanism allows the work platform to be raised and lowered along the mast tower in a smooth continuous manner for improved safety. The direct connection design of the lift mechanism also allows the entire scaffolding assembly to be very quickly erected and installed.

These and other advantages of the present invention will become apparent from the following description of an embodiment of the invention with reference to the accompanying drawings.

DESCRIPTION OF THE PREFERRED EMBODIMENT

Figure 1:
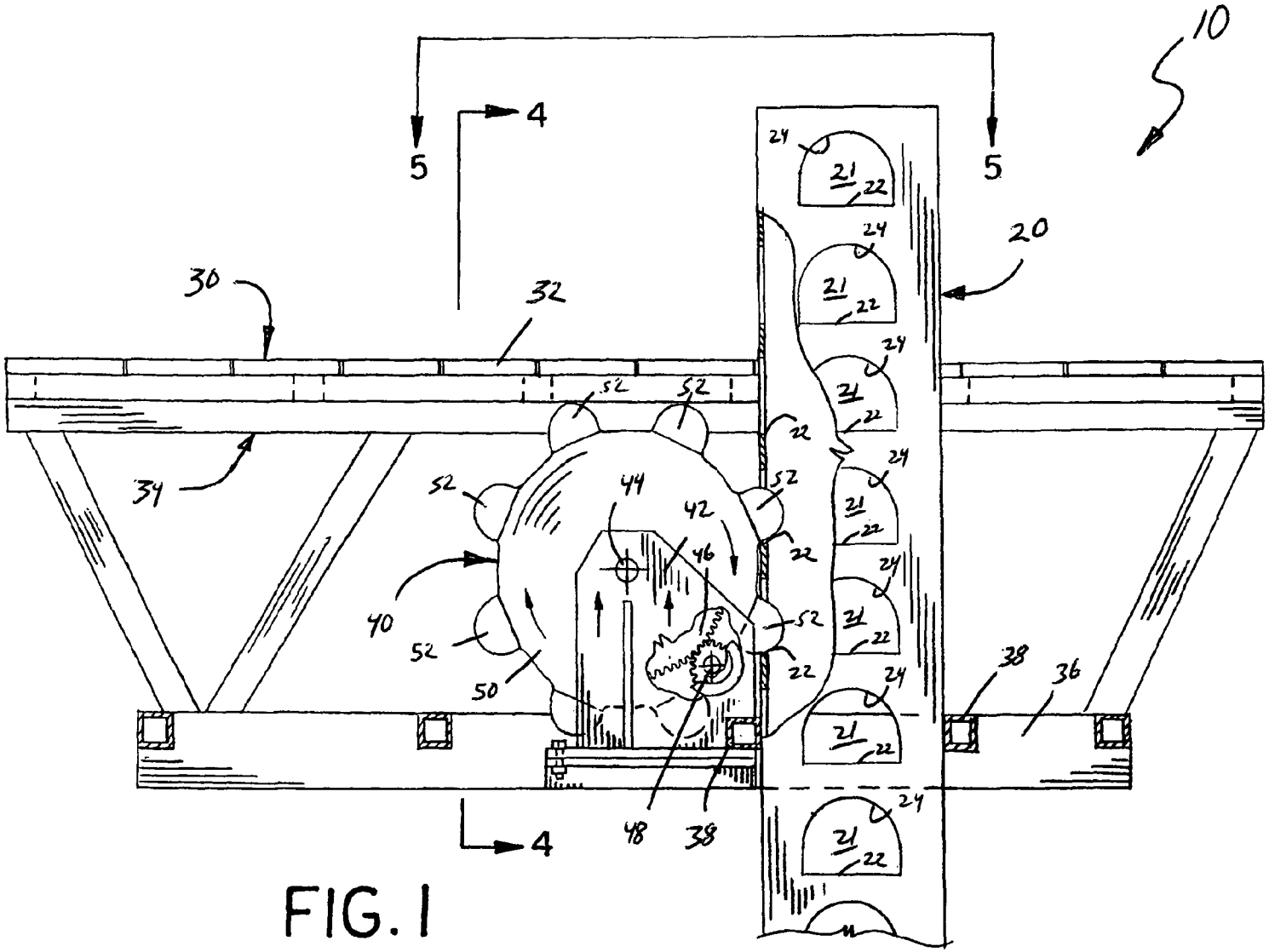
FIG. 1 is an end elevation view of an embodiment of the self-elevating platform scaffolding of this invention with a cut-away view of the lift mechanism.
Figure 2:
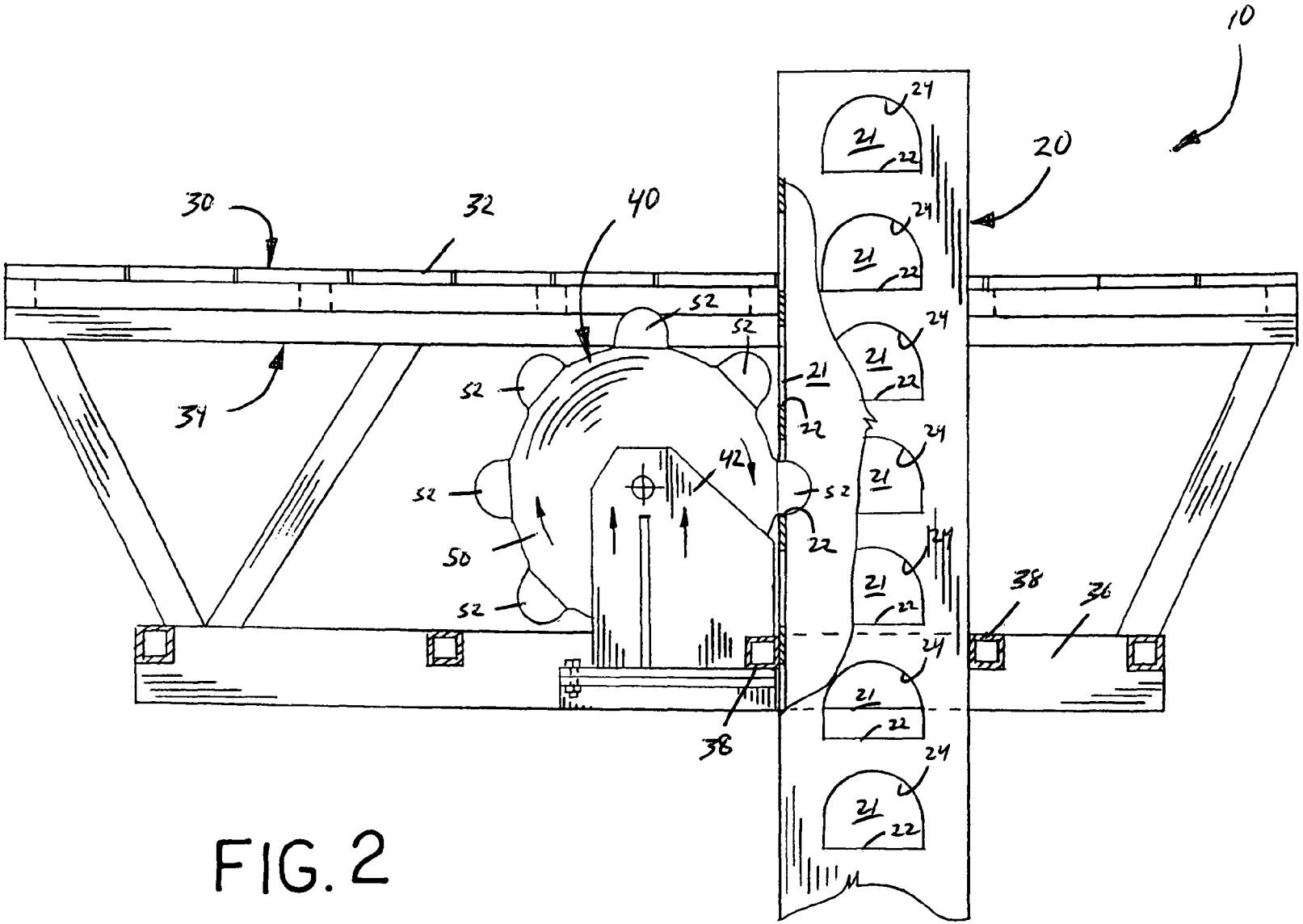
FIG. 2 is an end elevation view of the scaffolding of FIG. 1 showing the pinion wheel rotated in one position engaging the mast tower.
Figure 3:
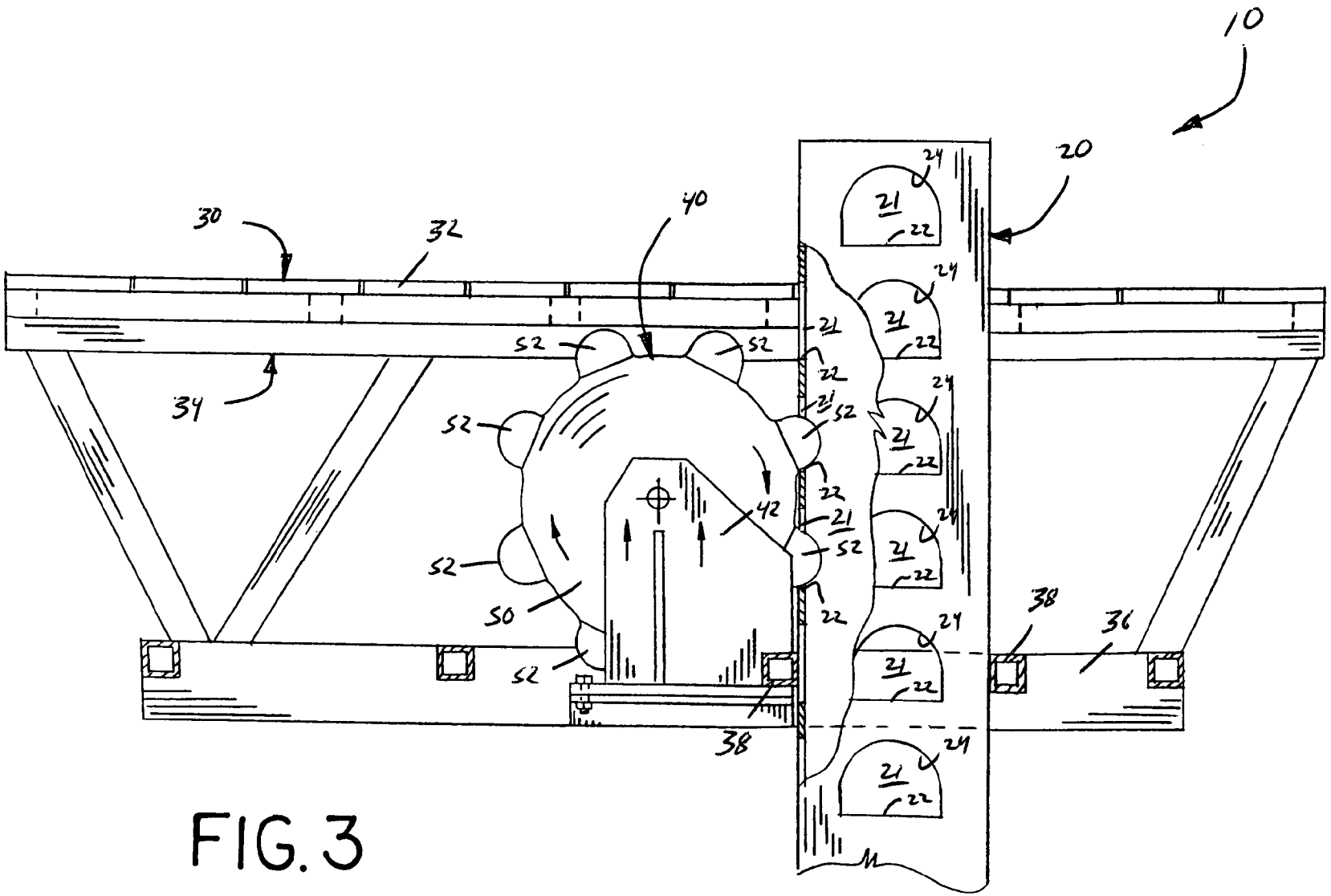
FIG. 3 is another end elevation view of the scaffolding of FIG. 1 showing the pinion wheel rotated in second position engaging the mast tower.
Figure 4:
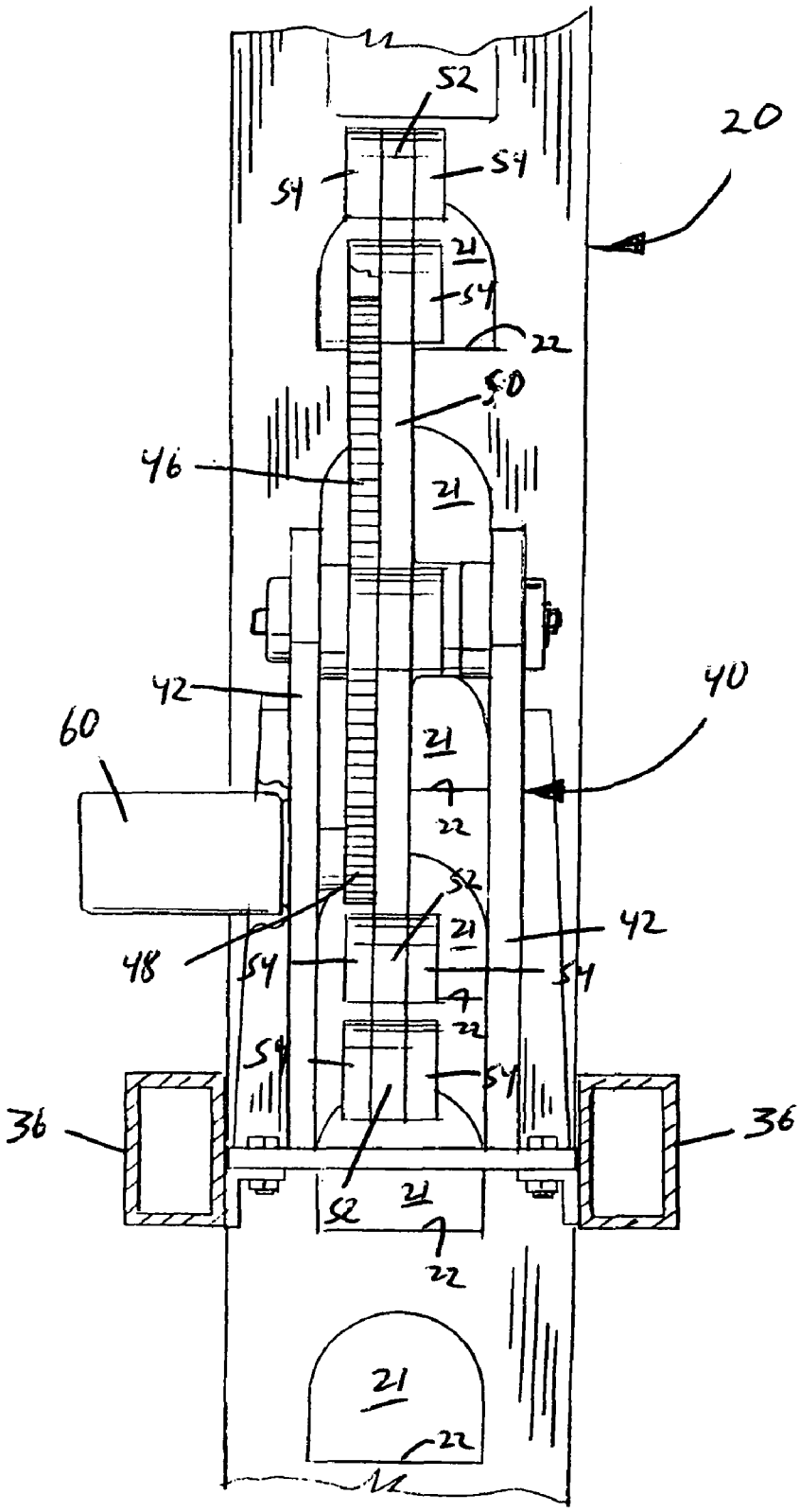
FIG. 4 is a plan section taken along the line 4-4 FIG. 1.
Figure 5:
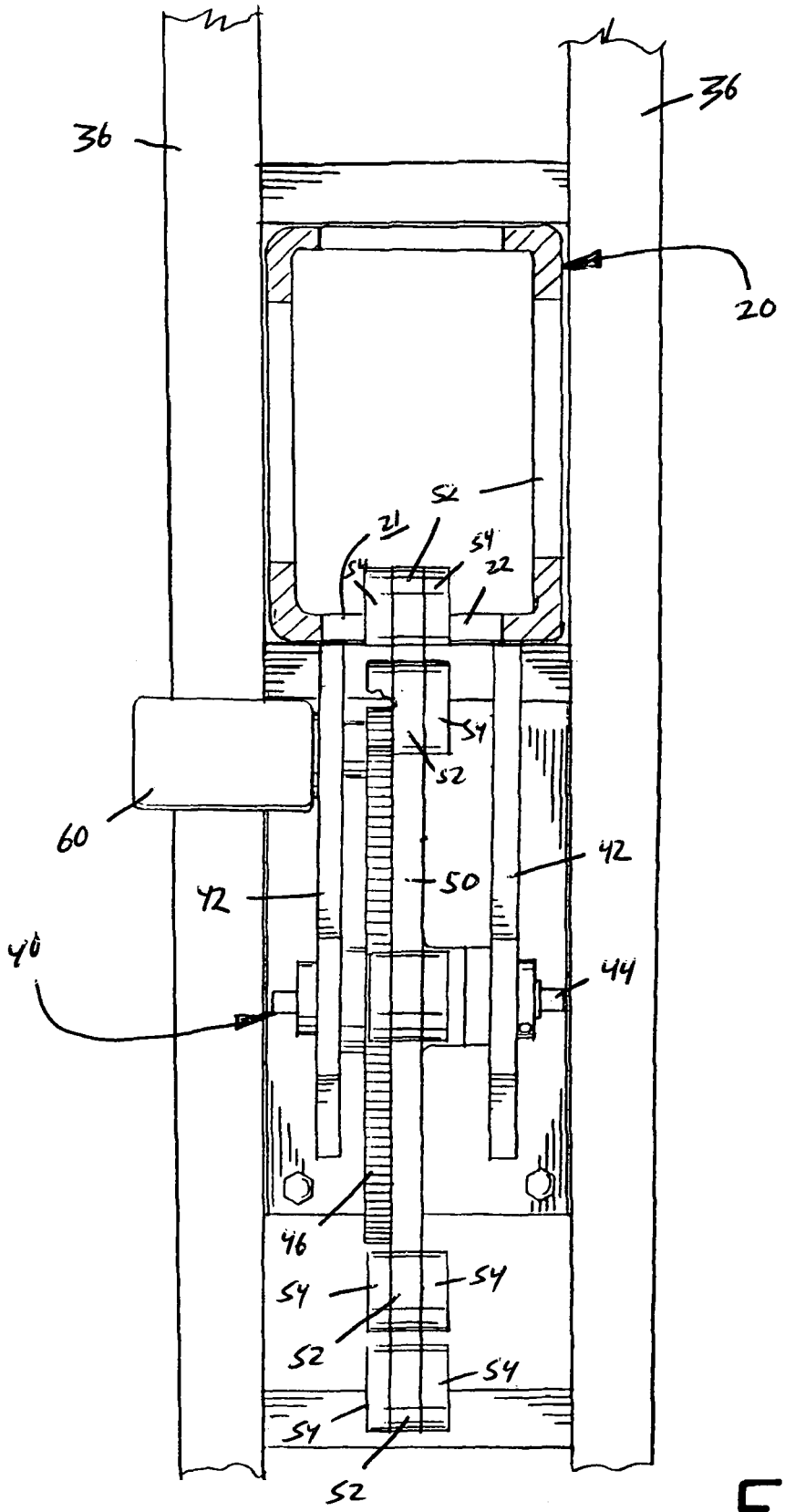
FIG. 5 is a plan section taken along the line 5-5 FIG. 1.

Referring now to the drawing, reference numeral 10 generally identifies a self-elevating platform scaffolding embodying the teaching of this invention. Scaffolding 10 includes a vertical mast tower 20, movable horizontal work platform 30 suspended from the mast tower and a lift mechanism 40, which operatively engages the mast tower to allow the platform to be raise and lower the platform vertically along the length of the tower. For simplicity of illustration and description of the construction and operation of scaffolding 10, a single mast tower is illustrated in the drawings and described herein. Although scaffolding 10 is illustrated as having a work platform suspended from a single mast tower, those of skill in the art will appreciate that the scaffolding may be modified within the scope of this invention to include multiple elevating platforms suspended between multiple mast towers.

Mast towers 20 are formed from a series of stacked, box-type mast sections. Mast sections are connected end to end to form a continuous vertical column. Each mast section is constructed from four corner rails and covered by an outer skin of heavy gage sheet metal. As shown, mast tower 20 has four flat vertical faces. Each face has a plurality of semi-circular openings 21 vertically orientated and evenly spaced in succession along the length of the mast towers. Each opening 21 is defined by a horizontal bottom edge 22 and an arcuate upper edge 24. Openings 21 are equally spaced with approximately 9.8175 inches between adjacent bottom edges 22.

Work platform 30 includes an upper deck 32 supported by a sub-frame 34 constructed of various metal beams, braces and cross members. Mast towers 20 extend through work platform 30 and are shiftably seated between side members 36 and cross members 38 of sub-frame 34. To facilitate movement along the mast towers 20, work platform 30 is movably coupled to the mast towers using various rollers and carriage assembles, which allow the work platform to move freely and uniformly up and down the mast towers without binding or twisting. For simplicity of description and illustration only, these rollers and carriage assemblies are not described herein, but are understood to be well known in the art.

Lift mechanisms 40 includes a rotating pinion wheel 50 driven by a hydraulic pump motor 60. Pinion wheel 50 operatively engages mast tower 20 to raise and lower platform 30. Pinion wheel 50 is rotatably mounted between two support members 42 mounted to sub-frame 34 of platform 30. As shown, pinion wheel 50 rotates on an axis perpendicular to the longitudinal axis of both platform 30 and mast tower 20. A pinion gear 46 is mounted to one side face of pinion wheel 50. Pinion wheel 50 and pinion gear 46 turns on a center shaft 44 journaled between various bearings and bushings. Pump motor 60 turns a drive gear 48, which meshes with pinion gear 46 to turn pinion wheel 50.

Pump motor 60 is powered by an internal combustion engine (not shown) and actuated by a system of valves and controls (not shown). This type of hydraulic system is well known in the arts. While illustrated and described as being driven by a hydraulic system, the pinion wheel can be driven by any conventional power system. Ideally, the hydraulic system should allow platform 30 to be safely locked in position as well as, being raised and lowered along mast tower 20. It should be noted that lift mechanism 40 may be modified to include multiple pinion wheels, with one or more pinion wheels operatively engaging each mast tower to raise or lower the platform. Each pinion wheel being driven by its own pump motor, but powered and controlled as part of an integrated hydraulic system. For simplicity of explanation and illustration only, lift mechanism 40 is shown and described herein using only a single pinion wheel operating on a single mast tower. The lift mechanism should also allow redundant back up systems and controls for safe operation of the scaffold.

Pinion wheel 50 directly engages mast tower 20 to raise and lower platform 30 as the wheel turns and moves vertically over the length of the mast tower. Pinion wheel 50 has a plurality of circular cogs 52 (eight cogs are illustrated in the drawings), which extend radially from the outer edge of the pinion wheel. Cogs 52 are configured to extend into openings 21 in mast tower 20. Each cog 52 has a contact edge 53, which runs from the apex of the cog to the junction between the cogs and outer edge of pinion wheel 50. A pair of curved shoes 54 are welded to both sides of cogs 52 to reinforce the cogs and provide a larger contact face for the contact edges of the cogs. Shoes 54 abut and extend around the outer edge of cogs 52. Pinion wheel 50 has a radius of approximately 12.5 inches to the edge between cogs 52. Cogs 52 have a radius of approximately 2.5 inches and the center of each cog is located approximately 13.5 inches from the center axis of pinion wheel 50.

Figure 6:
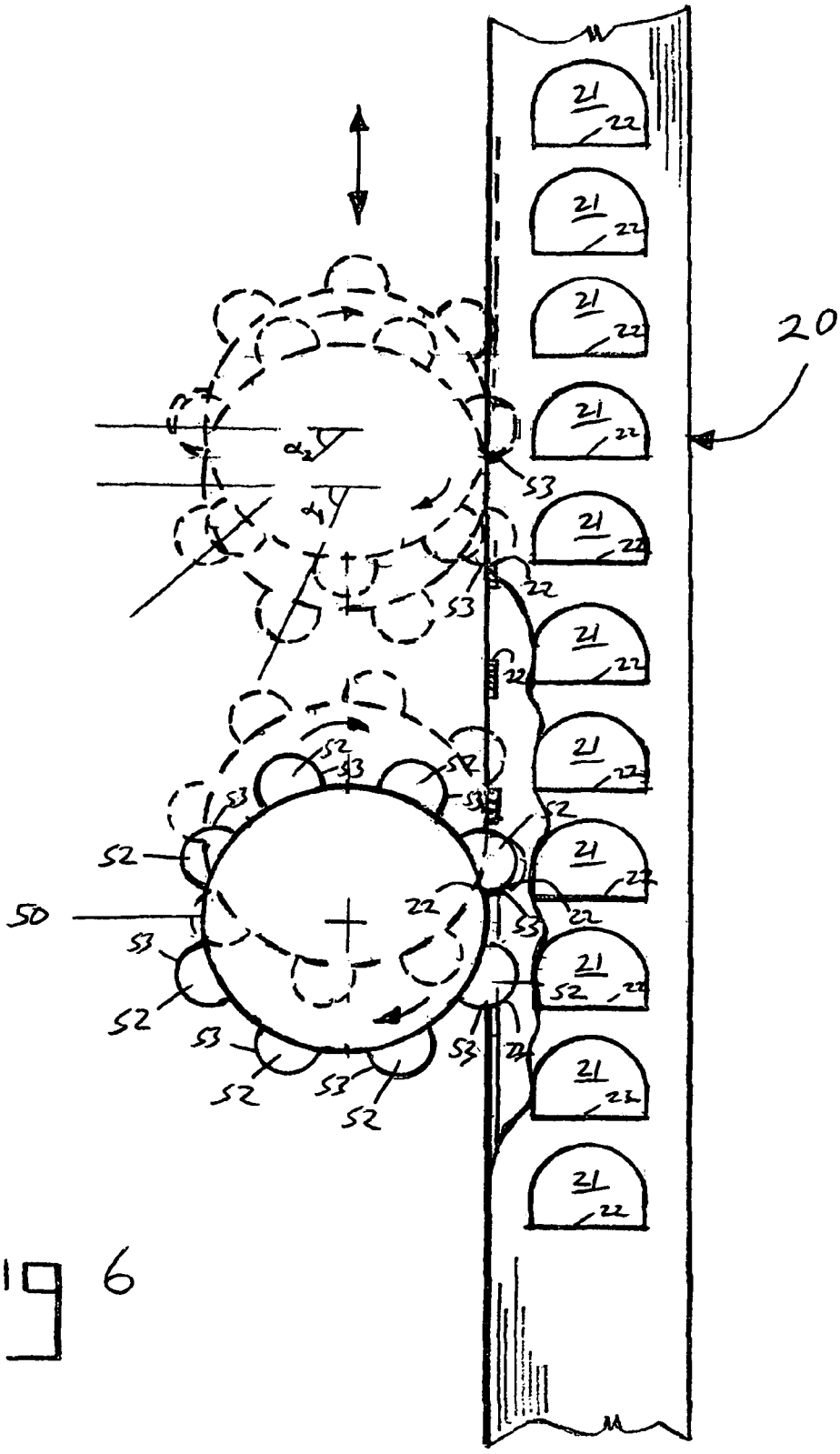
FIG. 6 is a simplified end elevation view of the pinion wheel and mast tower showing the pinion wheel rotating to "walk" up the mast tower.

As shown in FIG. 6, the rotation of pinion wheel 50 causes the wheel to "walk" up and down mast tower 20 to raise and lower platform 30. The geometric configuration of pinion wheel 50 is designed so that at least one cog 52 is always in positive contact with mast tower 20 as the pinion wheel "walks" up and down the mast tower. As pinion wheel 50 turns, each successive cog 52 is seated within an adjacent crescent opening 21 in masts 30 with the contact edge 53 bearing against bottom edge 22 of opening 21. The circular configuration of the cog 52 allows the point of contact between the cog and bottom edge 22 to move along the contact edge 53 as pinion wheel 50 walks up and down along mast tower 20. The geometric configuration of pinion wheel 50 ensures that a single cog is contacting the mast tower over approximately 48° of the pinion wheel's rotation. Each cog 52 bears against the bottom edge of the opening alone for approximately six degrees of rotation (illustrated as rotation between $\alpha_1$ and $\alpha_2$ in FIG. 6), before an adjacent cog comes into engagement with the bottom edge of an adjacent opening. Two adjacent cogs 52 are contacting mast tower 20 over approximately 312° of rotation. Consequently, 85 percent of the time, the weight of platform 30 is supported by pinion wheel 50 engaging mast tower 20 at two separate contact points. As a result of this pinion wheel configuration, pinion wheel 50 "walks" smoothly up and down mast tower 20 without any slippage as adjacent cogs 52 move into and out of contact with the mast tower.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following

I claim:

1. A scaffolding assembly comprising:

a vertical mast tower, the mast tower having a plurality of openings vertically spaced along the length of the mast tower, each of the mast tower openings is defined by a horizontal bottom edge and an arcuate upper edge connected to the horizontal bottom edge;

a generally horizontal platform shiftably suspended from the mast tower for vertical movement along the mast tower; and lift means with support members connected to a generally horizontal sub-frame element on the generally horizontal platform carried by the platform for moving the platform along the mast tower, the lift means includes a pinion wheel in direct mating engagement with the mast tower where rotation of the pinion wheel, a motor for rotating a drive gear meshed to a pinion gear on the pinion wheel to move the platform vertically along the mast tower, the pinion wheel having a first radius and the pinion wheel having a plurality of radially spaced circular cogs placed on the first radius of the pinion wheel, each circular cog configured to extend into one of the mast tower openings and having an outer edge which bears against the bottom edge of one of the mast tower openings when one of the circular cogs is inserted into the one of the mast tower openings, and wherein the pinion wheel has a first center axis and the first radius and wherein the cogs have a second radius and a second center axis distant from the first center axis, and wherein the distance between the second center axis and the first center axis is greater than the first radius, wherein the pinion wheel includes a pair of shoes mounted to both side of each of the circular cogs, the shoes also having a contact edge which bears against the bottom edge of one of the mast tower openings when one of the circular cogs is inserted into the one of the mast tower openings, and wherein the contact edge of the shoes abuts and extends around the outer edge of the circular cogs, and wherein the cogs are configured such that two adjacent cogs contact the mast tower along its contact edge 85 percent of the time as the pinion wheel rotates.

* * * * *